US008662696B2

(12) United States Patent
Lederer et al.

(10) Patent No.: US 8,662,696 B2
(45) Date of Patent: Mar. 4, 2014

(54) SOLAR-POWERED JAR LID

(75) Inventors: Charlos Penn Lederer, Madison, NC (US); Thomas William LuRose, Greensboro, NC (US)

(73) Assignee: Colonial Tin Works, Inc., Greensboro, NC (US)

( * ) Notice: Subject to any disclaimer, the term of this patent is extended or adjusted under 35 U.S.C. 154(b) by 151 days.

(21) Appl. No.: 13/366,955

(22) Filed: Feb. 6, 2012

(65) Prior Publication Data

US 2012/0134143 A1 May 31, 2012

Related U.S. Application Data

(60) Provisional application No. 61/439,477, filed on Feb. 4, 2011.

(51) Int. Cl.
*F21V 33/00* (2006.01)

(52) U.S. Cl.
USPC ..... 362/154; 362/101; 362/157; 362/158; 362/183

(58) Field of Classification Search
USPC ..... 362/157–159, 161, 183, 101, 154; 215/228
See application file for complete search history.

(56) References Cited

U.S. PATENT DOCUMENTS

| | | | | |
|---|---|---|---|---|
| 5,178,450 | A * | 1/1993 | Zelensky et al. | 362/154 |
| 5,406,466 | A | 4/1995 | Stokes | 362/153.1 |
| 6,886,959 | B2 | 5/2005 | Record | 362/161 |
| 2010/0308005 | A1 | 12/2010 | Callanan | 215/228 |

* cited by examiner

*Primary Examiner* — Stephen F Husar
*Assistant Examiner* — Meghan Dunwiddie
(74) *Attorney, Agent, or Firm* — MacCord Mason PLLC

(57) ABSTRACT

A solar-powered lighting lid is shown and described. In one embodiment, the reclosable lid comprises a light emitter, a top opaque surface having a solar panel and a photo resistor, and a rechargeable storage device. Typically, the solar panel recharges the storage device and the storage device powers the photo resistor. Further, when an ambient darkness is detected by the photo resistor, the light emitter is activated and light is at least partially visible through the transparent jar. Additionally, a solar light insert may be provided for cooperation between a jar and a band, ring or the like.

21 Claims, 7 Drawing Sheets

SOLAR-POWERED JAR LID

This application claims the benefit of U.S. provisional application No. 61/439,477, filed Feb. 4, 2011, which is incorporated herein by reference.

FIELD OF THE TECHNOLOGY

The present disclosure relates generally to jar decoration, and more particularly to a solar-powered Mason jar lid and insert that provides automated lighting effects.

BACKGROUND

Decorative elements contained in jars are popular ornamental motifs. Typical decorative jars include Mason jars, apothecary jars, jelly jars and the like. Candles may be positioned in, or adjacent to, the jars to illuminate their contents in an aesthetically-pleasing manner. However, covers to these jars must be removed when the candle is lit, which presents several safety concerns and further exposes jar contents to environmental elements, as well as introduces similar presentation concerns. Therefore, one common problem associated with highlighting decorative jars in dark environments, especially jars with ornamental internal features, is maintaining an appropriate, sustaining lighting source.

Decoration lights are often used to highlight homes, landscapes, public buildings, retail locations and the like, especially during holidays. Conventional decorative lights comprise low energy incandescent light bulbs, and more recently, light emitting diodes have been displayed to produce various energy-efficient lighting effects. There are several types of currently known decorative lights that are typically plugged into a wall outlet. As these lights are usually plugged in, they constantly draw from the power grid and expose the area to an unwanted electrical safety concerns, particularly in outdoor settings. Thus, solar power is an inexpensive, sustainable alternative to convert solar energy into electric power. However, many solar light arrangements use plastics and petrochemicals which are not very versatile for the consumer. Further, conventional methods fail to adequately highlight and illuminate decorative jar features in dark environments.

Therefore, Applicants desire systems and methods for automatically illuminating contents in a transparent jar to produce various lighting effects, without the drawbacks presented by the traditional systems and methods.

SUMMARY

In accordance with the present disclosure, a solar-powered lighting lid is provided for automatically illuminating contents in at least a partially transparent jar. This disclosure provides an improved reclosable lid and solar light insert that is convenient, efficient, and safe for the user, particularly when used in outdoor decorative environments. This disclosure may also allow for solar-powered lighting lid and insert kits, and related retrofit kits.

One aspect of the present disclosure is to provide a reclosable lid for cooperation with a transparent jar having an externally threaded top neck. The reclosable lid may include an internally threaded formation, a light emitter, a solar panel and a photo resistor. The internally threaded formation may be adapted to overlie the externally threaded top neck of the jar. Further, the lid may be adapted to be compressed in a weather resistant, including water resistant and waterproof, seal with the jar in an assembled position. A bottom surface of the lid may support the light emitter. A top opaque surface of the lid may support the solar panel and the photo resistor and is configured to be exposed to the ambient light environment. The rechargeable energy storage device is in electrical communication with the solar panel and the photo resistor. The solar panel recharges the energy storage device, while the energy storage device powers the photo resistor. Typically, when an ambient darkness is detected by the photo resistor, the light emitter is activated and the light emitted from the light emitter is at least partially visible through the transparent jar.

In some examples, the solar panel is mounted flush with the top surface. In yet other examples, the solar panel may be less than about sixty two millimeters in length. Further, lid may include a molded compartment for housing the energy storage device and having an opening to allow access to the energy storage device. There may be a waterproof seal between the molded compartment and the top surface of the lid.

In yet other examples, the light emitter may be about a one Watt light emitting diode. Typically, the light emitter is concealed from view in the assembled position. The transparent jar may be a Mason jar. In these examples, the light emitter projects light downward through the transparent Mason jar, thereby illuminating contents of the Mason jar. Typically, the light emitted from the light emitter is not visible through the top opaque surface.

The device may include control circuitry which connects the rechargeable energy storage device to the solar panel and to the photo resistor. The rechargeable storage device may be a replaceable battery.

In other embodiments, a solar light insert may cooperate between a transparent jar and a canning lid. The solar light insert may include a light emitter, a solar panel, a photo resistor and a rechargeable energy storage device. The top surface of the insert may have a diameter of between about 60 millimeters (mm) and about 65 mm. Similarly, the top surface of the insert may have a thickness of less than about 3 mm. Therefore, the top surface is generally self-centering when positioned between the Mason jar and the canning lid in a sealed position. The top surface may support the solar panel and the photo resistor in way that they are exposed to ambient light environment surrounding the device. And when an ambient darkness is detected by the photo resistor, the light emitter is automatically activated.

Typically, the rechargeable energy storage device is in electrical communication with the solar panel and the photo resistor. And the solar panel typically recharges the energy storage device and the energy storage device powers the photo resistor.

The top surface of the insert has a thickness of between about 2 mm and about 3 mm. Further, the top surface of the insert may include an alignment lip having a length of about 4 mm to about 6 mm. The transparent jar that the insert cooperates with may be a Mason jar. A molded compartment may house the energy storage device and include an opening to allow access to the energy storage device, i.e. to allow a user to replace the energy storage device. Typically, the molded compartment is less than about sixty-two millimeters in diameter. A waterproof seal may be secured between the molded compartment and the top surface of the insert.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
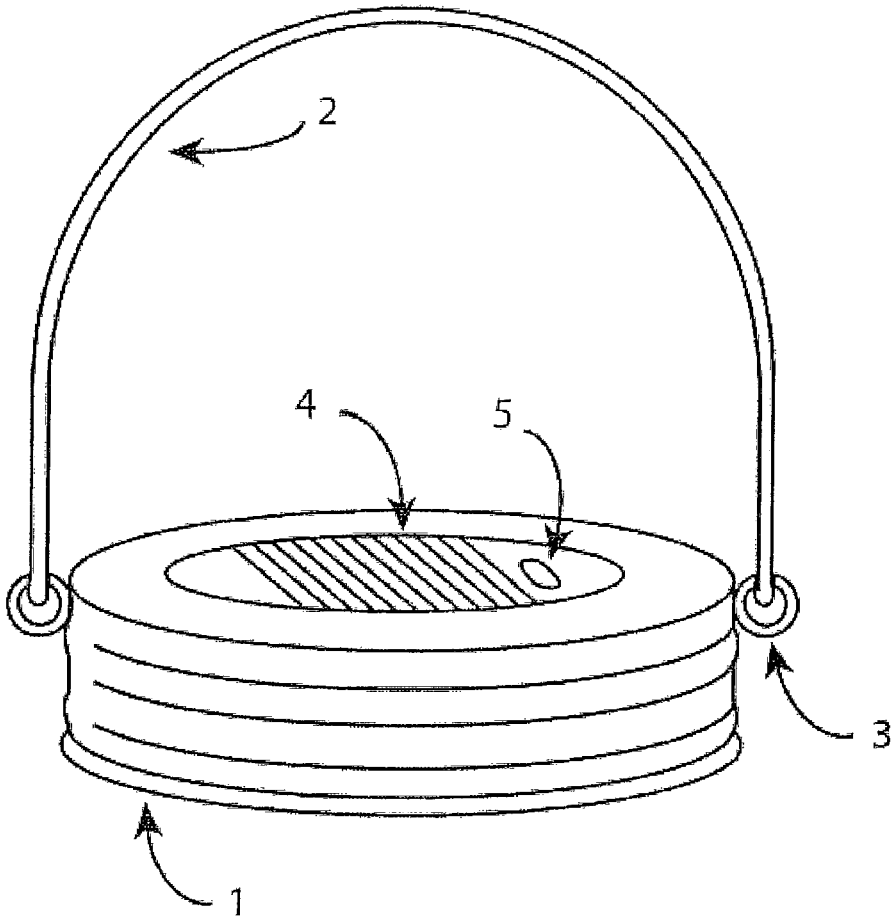
FIG. 1 is a side perspective view of a solar jar lid according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any invention thereto. As best seen in FIG. 1, a solar jar lid 1 is shown embodied according to the present disclosure. Typically, the lid 1 is a Mason jar-type conversion lid and includes a solar panel 4 to capture sunlight, or other ambient light, during the day, thereby charging an internal energy storage device. Further, the lid includes a light detection device 5 to recognize when the ambient light environment becomes dark to automatically activate a light emitter (not seen in FIG. 1). The result is an automated decorative lantern that illuminates a desired area in the jar through a translucent jar wall (not seen in FIG. 1).

As shown in FIG. 1, the lid 1 is configured to act as the housing for the solar-powered jar light converter, and is constructed to mate with jar threads, as discussed herein. Lid 1 includes a solar panel 4, solar cell or the like that is positioned on an outer face of lid 1 for receiving solar, or similar light energy, to convert the energy into electric energy. As illustrated in FIG. 1, solar panel 4 is typically positioned on the top face of the lid 1 to collect the maximum amount of light from an overhead light source. Further, the solar panel 4 may be mounted flush with the top face, or recessed below the top face, for an enhanced aesthetic appearance. For instance, as shown in FIG. 1, the sides of the solar plate are hidden from view within the lid. However, the solar panel 4 may also be mounted in other locations along the lid depending on the intended application, as long as the solar panel is able to be exposed to ambient light. For instance, the solar panel 4 may be positioned on a side face of the lid in an embodiment where the assembled unit is intended to lie horizontally on its side, as compared to the traditional vertical positioning.

As shown in FIG. 1, the solar panel 4 may be square or rectangular shaped, but other embodiments of the solar panel 4 are circular, for instance to blend with the circular design of the lid for an aesthetically-pleasing look. However, the size of the solar pane 14 must fit within the mouth of the corresponding lid, for instance the solar plate may have a supporting mating plate which typically must be less than about sixty seven millimeters, and in some examples about sixty two millimeters. As discussed hereinafter, the electric energy absorbed by the solar panel 4 is then stored in an energy storage device.

As further introduced in FIG. 1, the jar lid includes a photo resistor 5, light detection device or the like that acts as a sensor, for instance a light sensitive resistor, to actuate the light emitter. Typically, photo resistor 5 detects the presence, or lack thereof, of ambient light, and is configured to switch on the light emitter once the external ambient light is no longer detected. For example, when the lid is exposed to a reduced amount of ambient light, such as light during dusk and/or at night, the photo resistor 5 output enables a circuit to active a light emitter. On the contrary, when ambient light is sufficient, such as in the daytime, the power source is closed and the current loop is shut whereby the light emitter emits no light, thus conserving power for an extended nighttime use. Instead, light absorbed by the panel 4 generates current to recharge the power source. In this way, photo-resistor 5 serves as an auto-control and thus the power source is controlled automatically without an external power source and without user manipulation to illuminate jar contents. As shown, the light detection device is positioned on the top surface of the lid that is exposed to the ambient light environment, however other embodiments include the light detection device position in other areas on the lid, depending on the light sensitivity desired to activate the system.

In particular embodiments, as shown in FIG. 1, the lid 1 may include a handle 2. The handle may allow an assembled, sealed solar jar to hang from a hook, nail or other hanger, or be carried by a user as a portable, automated lantern. Further, lid 1 may include handle attachments 3 positioned on opposing sides of the lid to secure the handle 2 to the lid 1. In yet other examples, the lid may include brackets attached to the lid and/or jar to introduce various versatile display methods.

Figure 2:
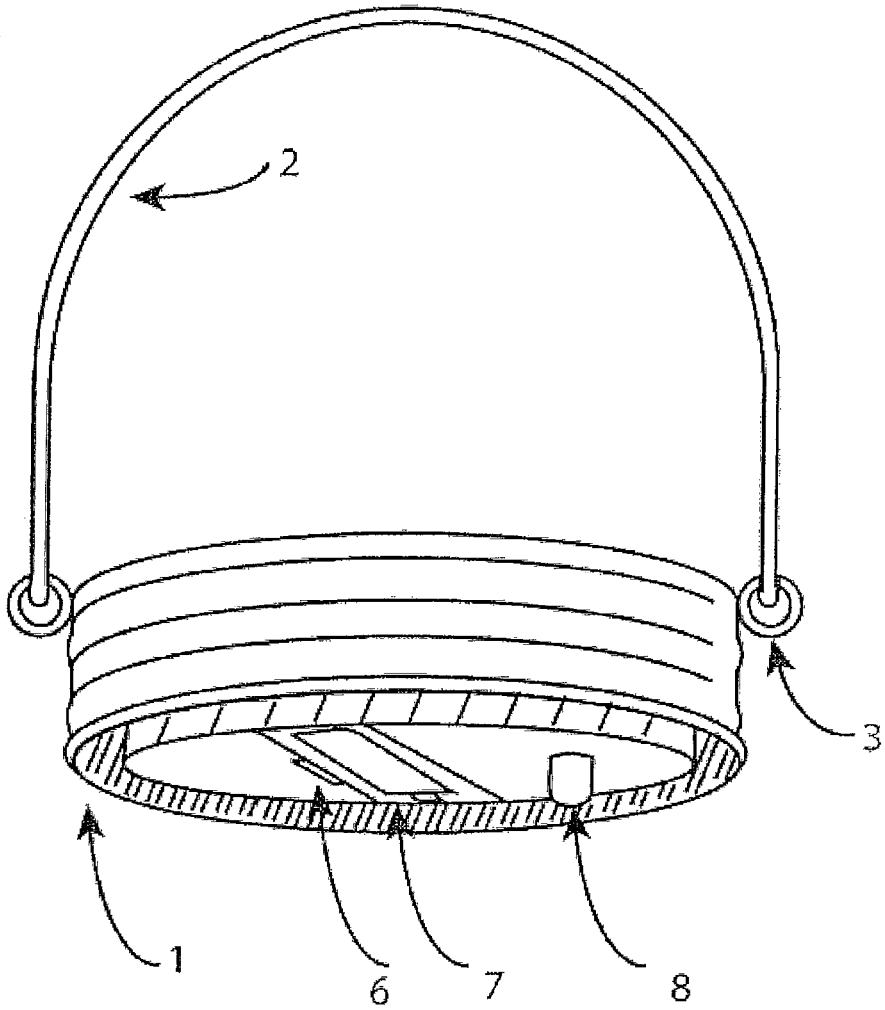
FIG. 2 is a bottom perspective view of the embodiment of FIG. 1.

FIG. 2 illustrates a bottom view of one embodiment of the lid 1 having an energy storage device compartment 6, which houses an energy storage device 7 in a molded, water-resistant, integral unit. In some examples, the energy storage device compartment 6 is about twenty millimeters in length for housing the energy storage device 7. Typically, the energy storage device 7 is a battery. For instance, the energy storage device 7 may be a direct current energy, or similar charge storage device, that is configured to provide sufficient energy to power the light emitter 8. The energy storage device may be a rechargeable battery or similar cell, for instance a nickel-cadmium battery, a nickel metal hydride batter or similar rechargeable battery. The energy storage device 7 powers the light detection device 5 and may power the light emitter 8. Further, the energy storage device 7 is typically positioned on the underside of lid 1 opposing the solar cell 4 to minimize the connection circuitry between the electrical elements to improve energy conversion/storage efficiency between the solar cell 4 and the energy storage device 7.

As shown in FIG. 2, the underside of lid 1 may include a light emitter 8 component to produce visual illumination when a voltage is applied to it. Typically, the light emitter 8 is positioned on the underside of the lid 1 to allow the light to shine down into the jar, thereby illuminating jar contents in an aesthetically-pleasing manner. If the jar is empty, the light can take reflection and transmission paths through the jar to create a lighting effect over the jar surface, for instance the outer jar surface. Further, the light emitter positioned downward also directs light to the ground, or the like, when the device is used as a portable light lantern. However, in other embodiments, the assembled unit may be positioned horizontally and light will similarly shine horizontally along the length of the jar. In some examples, light emitter 8 may be a light-emitting diode (LED), an incandescent light bulb, a fluorescent lamp, a halogen lamp, a lamp based on the light emission of gasses (i.e. a neon light or the like) and the like lamps. In particular embodiments, the power output of the light emitter may be about 0.1 to about 2.0 Watts. For instance, the power output of one LED light emitter may be about 1 Watt. Further, the lid may include multiple light emitters.

In other examples, the light emitter 8 may produce illumination in a non-visible spectrum, for instance such as an infrared or ultraviolet (i.e. a black light) to produce unique visual illumination effects, particularly when paired with corresponding black light-absorbing articles in the jar.

In yet additional examples, the LED light source may be single or multiple colors, and may be configured to flash, alternate colors, sparkle or the like in a predetermined pattern. In an alternate embodiment, the lid may include a traditional incandescent light bulb. Further, the light emitter may include a combination of two, or more, of any of the light emitters discussed herein.

Additional embodiments include a switch to allow for an "always-on" position. For instance to continuously power the light emitter 8, or only when the light detection device switches the power to an "on" position. The switch may also allow the light emitter 8 to be constantly powered when positioned in the "on" position to activate the power circuitry, regardless of the ambient light environment.

Figure 3:
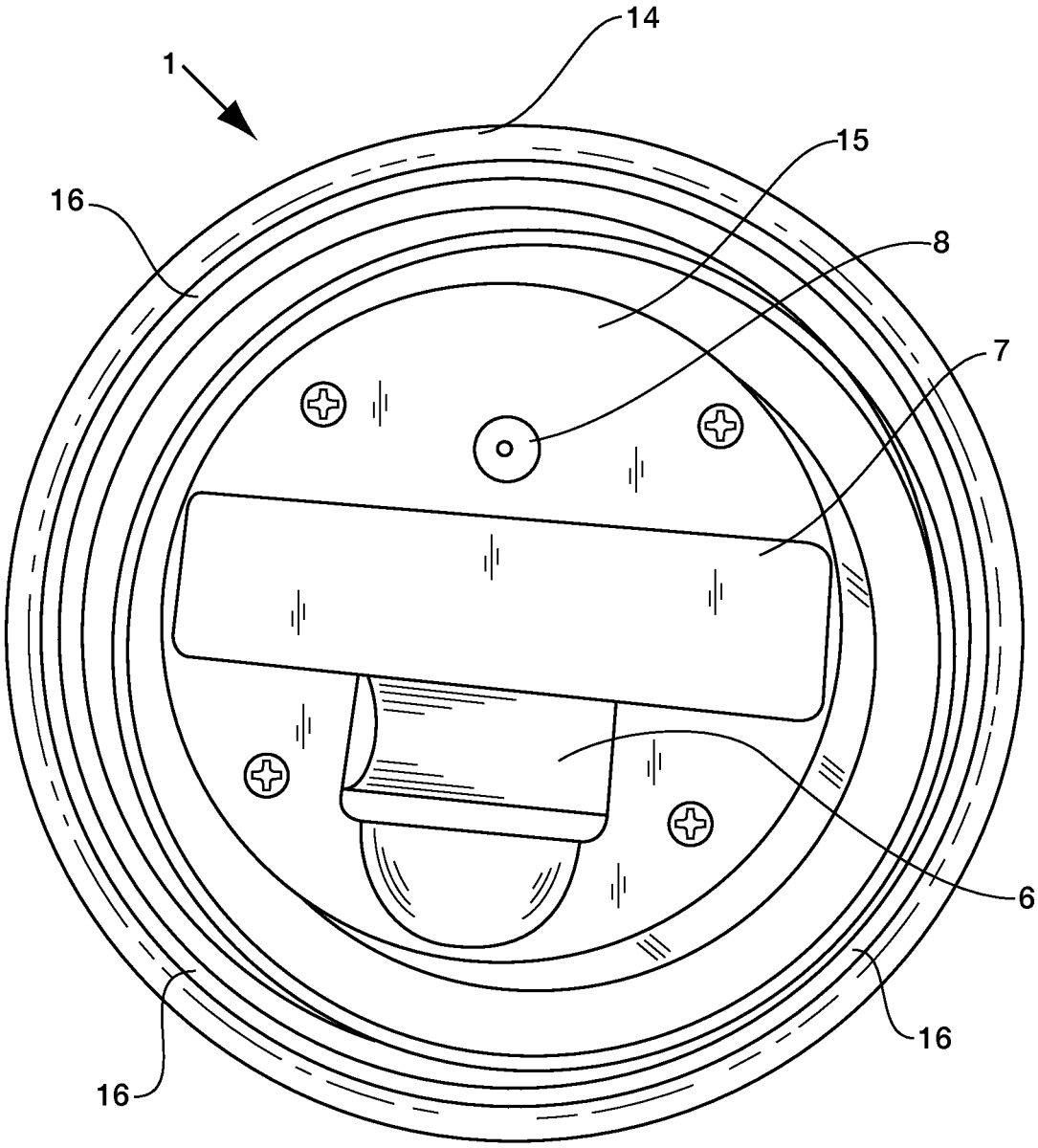
FIG. 3 is a bottom view of the embodiment of FIG. 1.

FIG. 3 illustrates that the configuration of the solar jar lid 1 allows the assembly to be aligned and sealed on a variety of jars, such as the wide mouth of a mason-type jar, or any other type of common threaded pattern of jars. In this particular arrangement, the light detection device 5, the solar panel 4, the energy storage device 7 and the light emitter 8 are all housed efficiently within the lid 1. As seen in FIG. 3, there is a gap 16 between the light assembly insert 15 and the outside rim 14 of the lid that is wide enough to allow the mouth of the jar to reside in gap 16 when the lid is threaded against the jar. In some examples, the gap 16 is about 7.5 mm to allow the lid to engage and seal a standard jar threading, for instance the threading found on a Mason-type jar.

Figure 4:
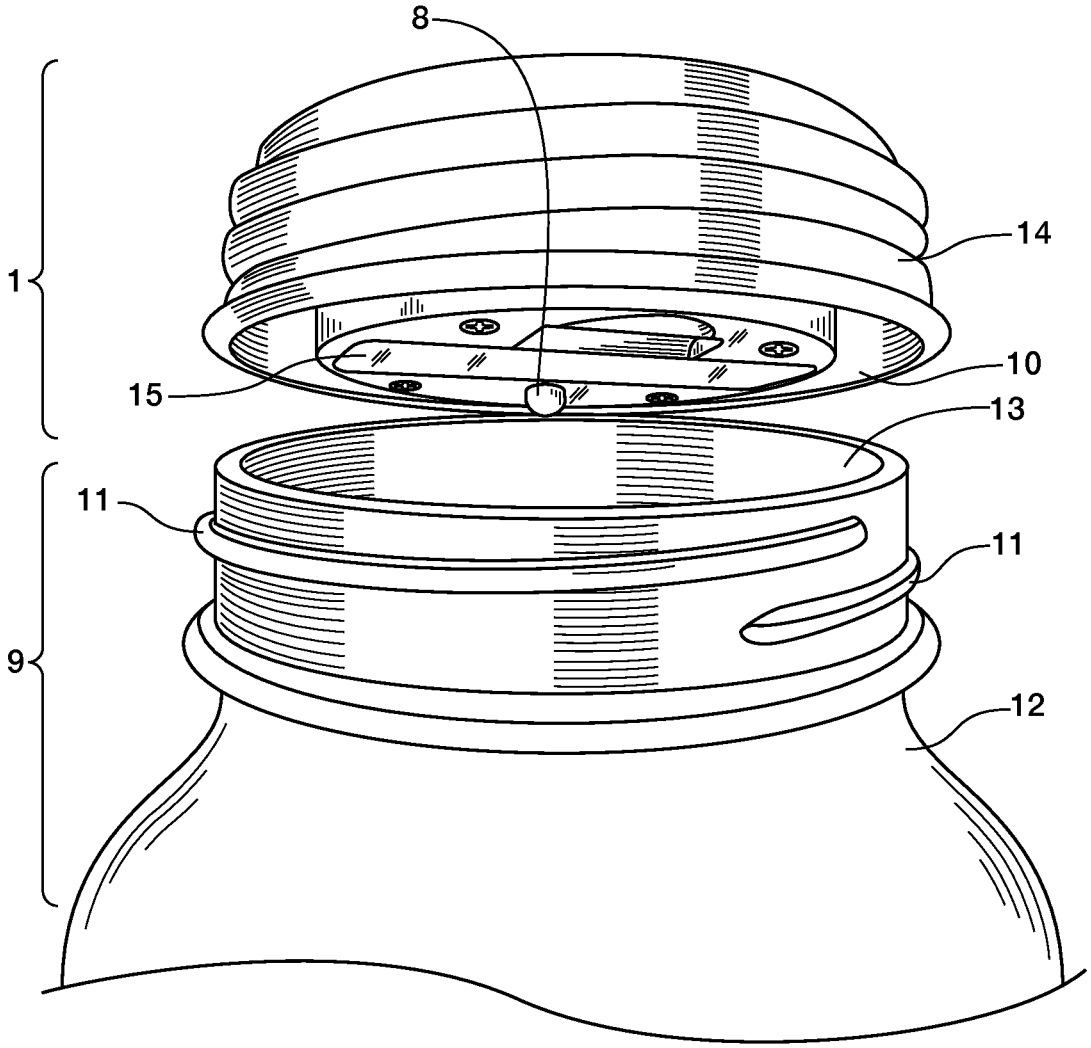
FIG. 4 is a side perspective view of solar lid of the embodiment of FIG. 1 and a Mason jar partially aligned in an unsealed position.

As shown in FIG. 4, the lid 1 acts as a closure assembly having an annular internally threaded formation 10. The annular internally threaded formation 10 is adapted to mate with an externally threaded formation 11 on the neck 12 of a jar 9. Typically, the lid 1 is a metal construction, for instance, steel, including, not limited to galvanized steel, aluminum or the like and has a flat upper face opposing the bottom surface 15 of the insert which supports the light emitter 8. And in some examples, the lid is opaque to minimize, or eliminate light transparency. For instance, the opaque lid will shield light from the light emitter from shining upward though the lid, but instead will contain light through the length of the jar to illuminate articles on the distal end of the jar.

FIG. 4 further illustrates the solar lid being partially aligned in an unsealed position with a jar. As shown, Mason jar 9 has at its upper open neck 12 an external thread formation 11 for mounting the internally threaded formation 10 of lid 1. Mouth opening 13 of the jar 9 is sized to generally accept the insert of the lid. For instance, the inner diameter of the mouth 13 is about 60 mm, while the outer diameter of mouth is about 67 mm. Therefore, thickness of the glass of the mouth 13 of the Mason jar is typically about 3.5 mm. Other embodiments of jars may vary, but the threads of the inner diameter of the lid are generally sized so as to fit snuggly over the inner diameter of the mouth 13 in a sealed, assembled position.

Figure 5:
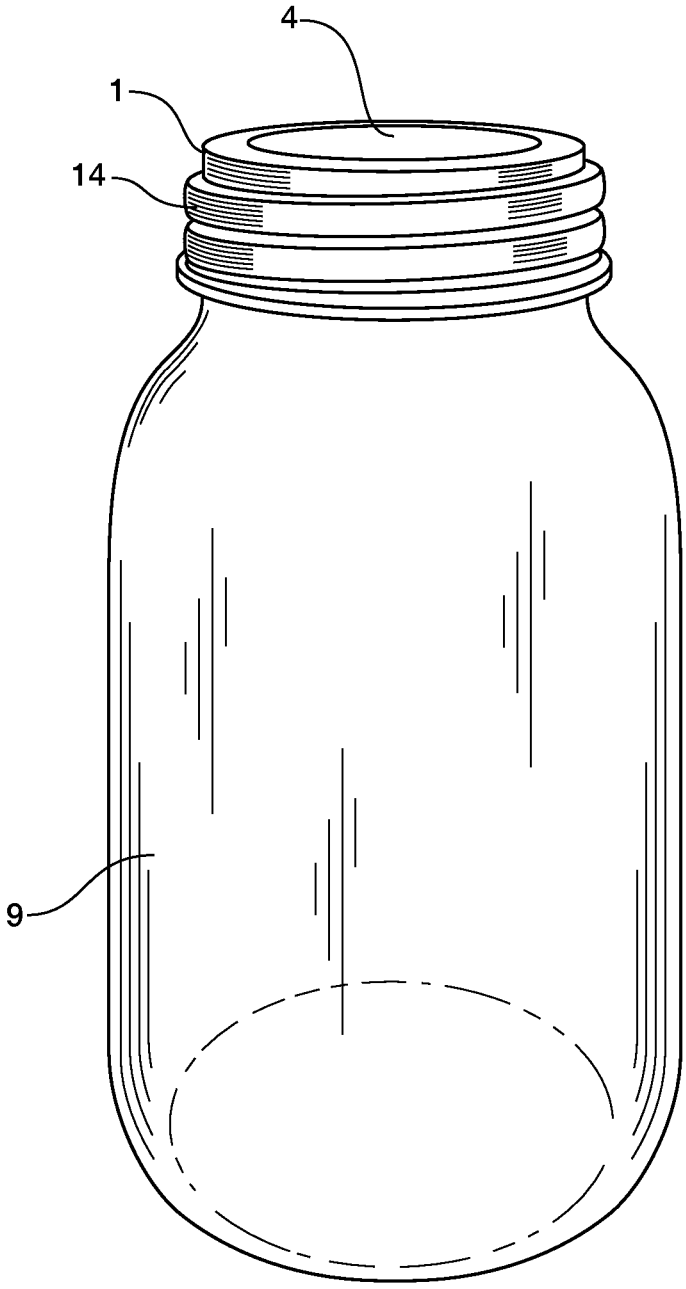
FIG. 5 is a side perspective view of a solar lid of the embodiment of FIG. 1 and a Mason jar sealed in an assembled position.

FIG. 5 shows one embodiment of the lid 1 and jar 9 in its assembled form. The jar 9 is typically made to resemble an antique jar, such as an old-time Mason jar. As a result, the desirable and popular Mason jar look can be obtained in a wholly unit light source. Since the insert top having the photo cell and the photo resistor can be positioned where the traditional lid is, the lid 1 for a Mason jar would screw, or ring, to complete the cap of the jar. But other examples include similar jars with overlapping threads. For instance, the threads may be standard jar threads that are readily available on canning jars, antique Mason jars, modern and antique glass containers and the like. The lid 1 is generally secured to the jar so as to form a sealed, integral lantern unit that is recloseable via the opposing threading. As shown in FIG. 5, the assembled unit may be water resistant, and waterproof in some examples. In this way, the assembled unit absorbs sunlight from a top surface and converts the sunlight into power to illuminate the jar automatically without exposing the jar, and its contents, to the outside weather environment. Variation in jar size can result in differing depths of penetration of the electrical lid insert components, therefore various combination of sizes can be used within the scope these inventions.

Further, the jar is preferably provided with two regions, an open mouth that is covered with the opaque top lid 1, and a translucent outer section that is light-permeable so that as much light from the light emitter is visible as possible.

Figure 6:
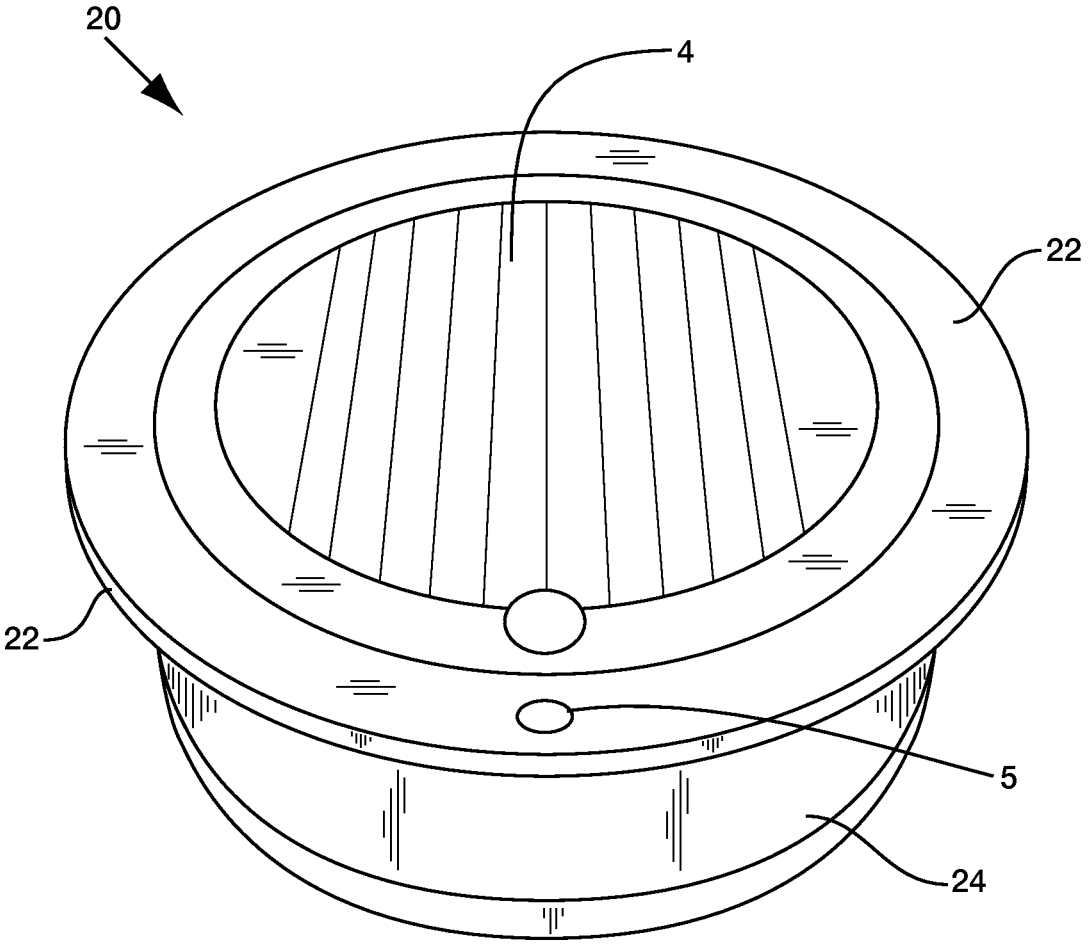
FIG. 6 is a perspective side view of a solar light insert.
Figure 7:
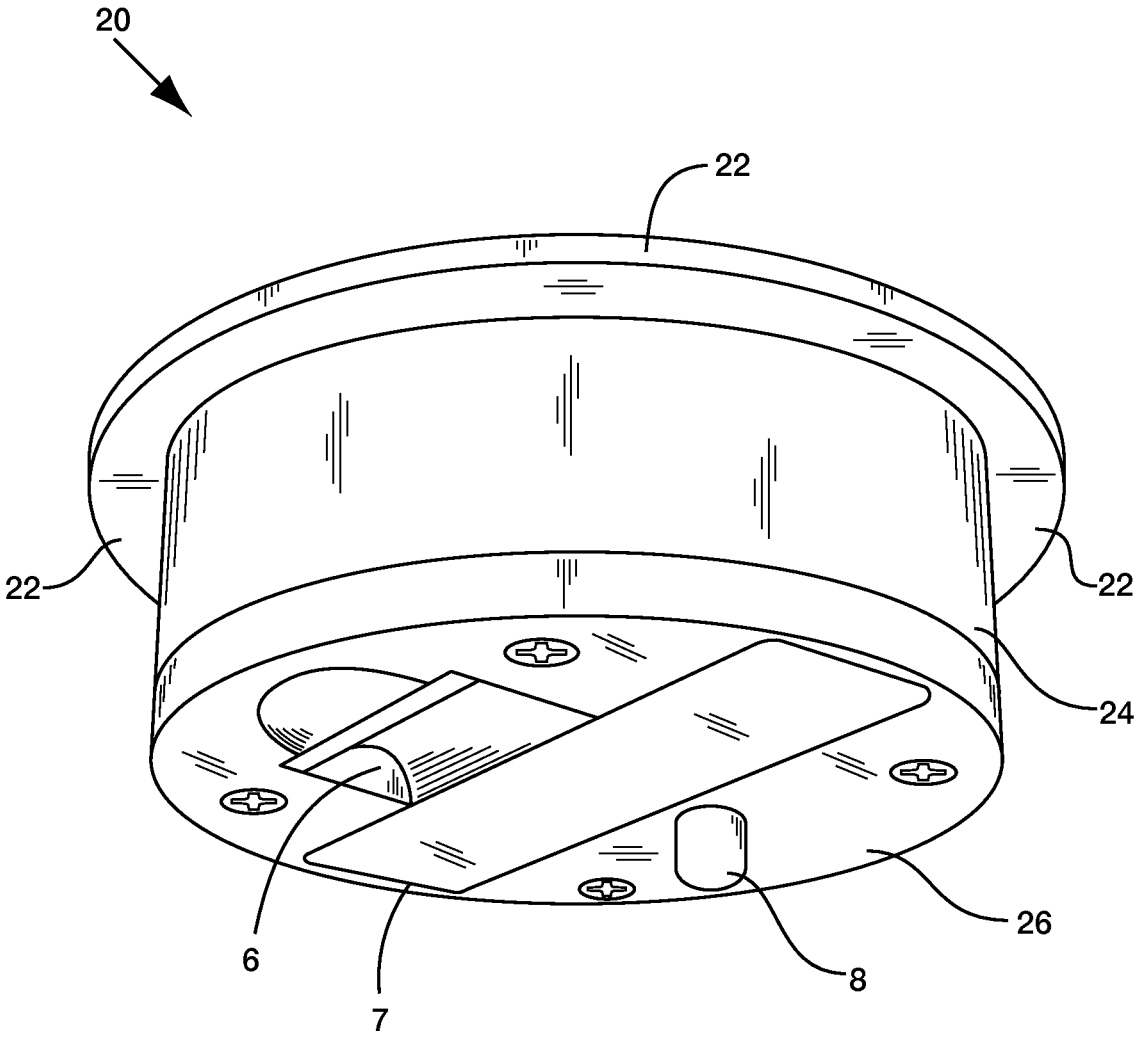
FIG. 7 is a perspective bottom view of the embodiment of FIG. 6.

FIGS. 6 and 7 illustrate isolated components of a solar light insert 20 which aligns between a jar and a canning lid to produce any of the solar jar units described herein. Typically, the solar light insert 20 is sized to be self-centering between the mouth of the jar and the band, ring or the like in an assembled position. In such an embodiment, the light emitter 8 will be centered over the jar cavity so as to align with jar contents to create an aesthetically-pleasing lighting effect. For instance, the top surface 22 of the insert 20 may be between sized about sixty to about sixty-five millimeters in diameter to fit within the screw-on ring boundary. Further, the lip thickness of the top surface 22 is less than about three millimeters in length, again to seal the jar's mouth and the canning lid in a weather-proof assembled position. However, in particular examples, the lip thickness of the top surface 22 may be larger, for example about two to about three millimeters, including about two and half millimeters, depending on the thickness of the Mason jar. Further, the lip between side face 24 and the outer diameter of top surface 22 may have a length of about four millimeters to about 6 millimeters, for instance about five and half millimeters. In one embodiment, the underside of the outer perimeter of the top surface 22 has conical shape down to the side face 4. The light of the insert beaming the conical face against the circular jar rim, which acts as self-centering device when the insert is placed on the jar lid.

The side face 24 of the solar insert 20 is sized to position the light emitters below the top surface 22 within the jar cavity, but also at a minimal depth to conceal the electronic components from the side perspective. As shown, the height of side face 24 is about eighteen millimeters. Further, the diameter of the side face 24 is about fifty to about sixty millimeters, for instance fifty-four millimeters. However, variation in jar size can result in differing depths of penetration of side face 24, therefore other embodiments include a combination of side face 24 sizes. Other embodiments of the top surface, lip, side face and the like elements can be a variety of shapes, styles, and sizes for the convenience of its user, for example extended fins versus a complete circular pattern. Similarly, the orientation and placement of the soar light insert 20 may include a variety of depths, sizes, and arrangement with respect to the canning lid, so long as the solar panel 4 and photo resistor 5 are exposed to the ambient light environment and the jar threads and canning lid threads may form the integral lantern unit as described herein.

In other embodiments, the disclosure includes a solar lid conversion and/or retrofit kit. In this embodiment, the kit may comprise a lid or insert having at least one of a solar panel, e.g. any of the solar panels previously shown or described; a photo resistor, e.g. any of the light detection devices shown or described; a light emitter, e.g. any of the light emitter devices shown or described; and an energy storage device, e.g. any of the arrangements to power the light detection devices and light emitters shown or described. Most typically, each conversion kit, e.g. any of the lids or inserts previously shown or described, are adapted to convert any canning or common jar with compatible threads into the solar powered lantern.

In use, the user may place the assembled device in a location that receives light, optimally some amount of direct sunlight focused on the solar cell. Further, each conversion lid may be attached to a variety of compatible jars. Additionally, the jars may be filled with a variety of objects, shapes, styles, and sizes for the convenience of its user or the jar may be left empty to create a unique visual effect. After the assembled device charges in light, the jar will be illuminated once the light detection device is triggered to direct power to the light emitter(s).

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A reclosable lid for cooperation with at least a partially transparent jar having an externally threaded top neck, the reclosable lid comprising:

an internally threaded formation adapted to mate with the externally treaded top neck of the jar, wherein the lid is adapted to be compressed toward the jar in an assembled position;

a bottom surface having a light emitter;

a top opaque surface having a solar panel less than about sixty two millimeters in length and a photo resistor adapted to be exposed to ambient light; and a rechargeable energy storage device in electrical communication with the solar panel and the photo resistor, wherein the solar panel recharges the energy storage device and the energy storage device powers the photo resistor, whereby when an ambient darkness is detected by the photo resistor the light emitter is activated and the light emitted from the light emitter is at least partially visible through the transparent jar.

2. The reclosable lid of claim 1, wherein the solar panel is mounted flush with the top surface.

3. The reclosable lid of claim 1, wherein the solar panel is less than about sixty two millimeters in length.

4. The reclosable lid of claim 1, including a molded compartment for housing the energy storage device and having an opening to allow access to the energy storage device.

5. The reclosable lid of claim 4, including a waterproof seal between the molded compartment and the top surface of the lid.

6. The reclosable lid of claim 1, wherein the light emitter is about a one Watt light emitting diode.

7. The reclosable lid of claim 1, wherein the light emitter is concealed from view in the assembled position.

8. The reclosable lid of claim 1, wherein the transparent jar is a Mason jar.

9. The reclosable lid of claim 8, wherein the light emitter projects light downward through the transparent Mason jar, thereby illuminating contents of the Mason jar.

10. The reclosable lid of claim 1, wherein the light emitted from the light emitter is not visible through the top opaque surface.

11. The reclosable lid of claim 1, including control circuitry connecting the rechargeable energy storage device to the solar panel and to the photo resistor.

12. The reclosable lid of claim 1, wherein the rechargeable energy storage device is a replaceable battery.

13. A solar light insert for cooperation between a transparent jar and a band, the solar light insert comprising:

a bottom surface having a light emitter;

a top surface having a diameter of between about 60 millimeters (mm) and about 65 mm and a thickness of less than about 3 mm whereby the top surface is self-centering when positioned between the jar and the canning lid in a sealed position, and the top surface having a solar panel and a photo resistor adapted to be exposed to ambient light, whereby when an ambient darkness is detected by the photo resistor the light emitter is automatically activated; and a rechargeable energy storage device in electrical communication with the solar panel and the photo resistor, wherein the solar panel recharges the energy storage device and the energy storage device powers the photo resistor.

14. The solar light insert of claim 13, wherein the top surface has a thickness of between about 2 mm and about 3 mm.

15. The solar light insert of claim 13, wherein the top surface includes an alignment lip having a length of about 4 mm to about 6 mm.

16. The reclosable lid of claim 13, wherein the transparent jar is a Mason jar.

17. The reclosable lid of claim 13, including a molded compartment for housing the energy storage device and having an opening to allow access to the energy storage device.

18. The reclosable lid of claim 17, including a waterproof seal between the molded compartment and the top surface of the insert.

19. The reclosable lid of claim 17, wherein the molded compartment is less than about sixty-two millimeters in diameter.

20. A reclosable lid for cooperation with a transparent Mason jar having an externally threaded top neck, the reclosable lid comprising:

an internally threaded formation adapted to overlie the externally threaded top neck of the Mason jar, wherein the lid is adapted to be compressed in a water resistant seal with the Mason jar in an assembled position to protect a decorative article in the jar;

a bottom surface having a light emitter;

a top opaque surface having a solar panel and a photo resistor mounted flush with the top surface and adapted to be exposed to ambient light; and a rechargeable energy storage device in electrical communication with the solar panel and the photo resistor, wherein the solar panel recharges the energy storage device and the energy storage device powers the photo resistor, whereby when an ambient darkness is detected by the photo resistor the light emitter is activated and the light emitted from the light emitter is at least partially visible through the transparent Mason jar but not transmitted through the top opaque surface of the lid, and whereby the light emitter is concealed from view in the assembled position.

21. A device for cooperation with at least partially transparent jar having an externally threaded top neck, the device comprising:

an internally threaded formation adapted to mate with the externally treaded top neck of the jar, wherein the device is adapted to be compressed toward the jar in an assembled position;

a bottom surface having a light emitter;

a top opaque surface having a solar panel and a photo resistor adapted to be exposed to ambient light;

a rechargeable energy storage device in electrical communication with the solar panel and the photo resistor, wherein the solar panel recharges the energy storage device and the energy storage device powers the photo resistor; and a molded compartment for housing the energy storage device, wherein said molded compartment having an opening to allow access to the energy storage device and a waterproof seal between the molded compartment and the top surface of the device, and whereby when an ambient darkness is detected by the photo resistor the light emitter is activated and the light emitted from the light emitter is at least partially visible through the partially transparent jar.

* * * * *